United States Patent [19]

Baril et al.

[11] 4,314,468

[45] Feb. 9, 1982

[54] STAMPING IN LIQUID FEMALE TOOL

[75] Inventors: Jacques Baril, L'Etang la Ville; Jean-Yves Gaborieau, Velizy, both of France

[73] Assignee: Societe de Vente de l' Aluminium Pechiney, Paris, France

[21] Appl. No.: 98,559

[22] Filed: Nov. 29, 1979

[30] Foreign Application Priority Data

Dec. 11, 1978 [FR] France ..... 78 35301

[51] Int. Cl.[3] ..... B21D 39/08

[52] U.S. Cl. ..... 72/57; 72/347; 72/379

[58] Field of Search ..... 72/347, 54, 57, 379; 29/421 R

[56] References Cited

U.S. PATENT DOCUMENTS

| | | | |
|---|---|---|---|
| 3,020,633 | 2/1962 | Huer | 72/57 |
| 3,383,891 | 5/1968 | Gertz | 72/57 |
| 3,495,433 | 2/1970 | Fuchs, Jr. | 72/347 |
| 3,516,274 | 6/1970 | Graham et al. | 72/57 |
| 3,596,485 | 8/1971 | Burk | 72/57 |
| 3,748,887 | 7/1973 | Widera | 72/345 |
| 3,769,824 | 11/1973 | Granzow | 72/57 |

*Primary Examiner*—Leon Gilden

*Attorney, Agent, or Firm*—Dennison, Meserole, Pollack & Scheiner

[57] ABSTRACT

The present invention provides an improved method for hydro-mechanical stamping wherein hollow products are formed from flat blanks by the cooperation of a punch and a liquid female tool. The present method particularly provides for submerging in the liquid the blank which is to be stamped, the level of the liquid being also maintained above the usual stamping ring. The invention further provides apparatus which acts to center the blank relative to the stamping ring, the present apparatus comprising an additional ring rigidly connected to the stamping ring and having radial apertures therein which form portions of circuitous liquid paths through which liquid flows on stamping, the paths acting to prevent localized rupture during stamping. The present method and apparatus find particular application to the high-speed manufacture of hollow, thin-walled articles of non-cylindrical shape.

5 Claims, 2 Drawing Figures

STAMPING IN LIQUID FEMALE TOOL

BACKGROUND OF THE INVENTION

1. Field of the Invention

The invention concerns an improvement to the method of stamping in a liquid female tool, and an apparatus for carrying out the method.

2. Description of the Prior Art

The conventional stamping process comprises mechanically deforming a flat element, described as a blank, by means of a punch and a female tool, to obtain an article in the form of a case or socket. The punch pushes back the central part of the blank at the bottom of the female tool and entrains the edge of the blank, or flange, which is "swallowed up" in the space between the punch and the female tool. The flange, which is generally circular with a maximum diameter F, thus forms the cylindrical lateral wall of the article of diameter D, corresponding to that of the punch. In order to prevent the flat flange from forming any folds during its deformation, it is necessary to guide it closely. In particular, the flange must initially be applied to the upper flat surface of the female tool by a blank holder.

It has been known for a long time that the method has been improved and has given rise to the process of stamping in a liquid female mold. The improved process is described e.g. on pages 17–23 of the revue "Machine Moderne" of September 1966, where it is described as "hydro-mechanical stamping".

In the process of stamping in a liquid female tool (or hydro-mechanical stamping), the metal female tool is replaced by a chamber full of liquid, in which the blank can be lowered when it is pushed by the punch. The liquid is put under pressure and applies the blank to the surface of the punch during its displacement. The liquid under pressure thus takes on the role of the female tool. As in conventional stamping, the flange of the blank must however be guided mechanically during its deformation. For this purpose, the free, upper section of the chamber is closed by a stamping ring which contains an aperture of a section corresponding to that of the stamped article, i.e. the largest section of the punch plus the thickness of the blank, with the clearance necessary to give passage to the metal of the flange when it is entrained to form the lateral wall of the article.

In the known process of stamping in a liquid female tool, the liquid level must be exactly flush with the upper level of the ring. When the blank is placed on the stamping ring at the beginning of the stamping operation, it is thus very exactly aligned with the level of the liquid, without leaving an air pocket of any size. As in the conventional method, the flange of the blank is pressed onto the ring by a blank holder.

As soon as the central part of the blank is depressed by the punch within the chamber, through the stamping ring, the liquid is put under pressure and tends to escape, flowing back between the flange of the blank and the stamping ring. The flange is lifted against the blank holder, allowing the liquid to escape between its lower surface and the stamping ring.

The pressure in the chamber and the rate at which the liquid escapes are determined at any moment by the speed at which the punch descends, the pressure applied by the blank holder and the width of the portion of flange still applied to the blank holder, which forms a seal.

The fact that the central part of the blank is constantly applied to the punch by the pressure of the liquid reduces the danger of the cylindrical, lateral wall folding during its formation. Cylindrical stamping ratios F/D of the order of 2.7 are permissible; these could not possibly be obtained by conventional stamping.

The process also enables conical or even ogival articles, which would require several passes by the conventional method, to be obtained in a single operation. And finally, the machinery is relatively simplified, since all that is required is to machine a thin stamping ring, rather than a female tool equal in height to the article to be stamped.

In spite of all these advantages, the process of stamping in a liquid female tool is still little used. In fact it requires care and special precautions. The free part of the blank inside the stamping ring has to be applied from the beginning of deformation and at all points to the liquid surface without leaving any air pocket. The liquid level must be precisely flush with the upper plane of the stamping ring, and this must be so at the beginning of every operation.

The precisely must entrain the flange within the chamber very regularly and symmetrically to form the lateral wall of the article stamped. The flange must thus be gripped and decelerated below the blank holder very regularly during its deformation. It is important that the surfaces of both the stamping ring and the blank holder should be cleaned carefully, to eliminate any drop of liquid which would result in unevenness and often even in a fracture of the blank.

Finally, as in conventional stamping, the blank must be lubricated very homogeneously to facilitate its sliding against the stamping ring and blank holder, from the very beginning of the stamping process, before the liquid can escape between the ring and the flange and act as a lubricant.

Unless a fairly complex apparatus is used to control the pressure by a pump and control valve, the pressures in the chamber will generally be very high, of the order of 1000 bars, which will increase the power requirement of the press.

It is also possible to fit a circular seal integral with the stamping ring and providing imperviousness between the flange and the stamping ring, then to control the pressure in the chamber solely by a pump and valve. However, the radial sliding of the flange on the upper surface of the seal is tricky and there are many hitches.

SUMMARY OF THE INVENTION

The method according to the invention avoids the various disadvantages of stamping in a liquid female tool while preserving all the advantages. It comprises not making the liquid level coincide with the upper plane of the stamping ring at the beginning of the stamping operation, but rather keeping the liquid level above that of the stamping ring and even above the blank. The blank is thus completely submerged from the very beginning of the stamping process.

Since the blank is constantly submerged, it is the pressurising liquid which provides lubrication between the blank and the stamping ring from the beginning of the stamping process. The liquid may simply be water or, preferably, a dilute solution of soluble oil.

With the blank completely submerged, there is no fear of any drops or pockets of liquid or air being left, which would produce disymmetric tensions when the punch descends. Wiping of the surfaces is no help. Since the blank is completely submerged, neither absolutely perfect horizontality of the stamping ring nor strict control of the liquid level are necessary. It is not helpful to grease the blank.

In order to simplify operations, the pressure chamber and its stamping ring may simply be submerged in a tank filled with liquid. When stamping takes place, the liquid expelled from the pressure chamber by the punch naturally overflows into the tank. The liquid then of course returns to the chamber by gravity at the end of the operation, when the punch is raised, then the article produced is discharged. It is obvious, however, that for particularly tricky stamping or very high production rates, the transfer of liquid and its pressure within the chamber can be controlled by a pump.

In the new process a problem is posed, however, particularly for high speed manufacture. Since the blank has to be completely submerged, how can it be centered accurately on the stamping ring? Strictly accurate centering is nevertheless indispensable if the liquid is to be prevented from emerging preferentially from one side rather than the other when the punch descends. This would produce di-symmetric strains and deformations which might form folds, even to the extent of tearing the blank during stamping.

The solution is to provide a device for centering relative to the stamping ring, in which the blank is fitted with very small clearance. The device may simply be a centering ring, thicker than the height of liquid above the stamping ring, so that it rises above the liquid. The centering ring must have troughs or holes for radial communication, so that the liquid levels inside and outside the stamping ring can be equalised properly at any time. The centering device must be firmly fixed on the stamping ring, e.g. by concentric nesting. The height h between the lower generatrices of the troughs or holes and the surface of the ring should preferably be greater than the thickness e of the blank.

DESCRIPTION OF THE PREFERRED EMBODIMENTS

Figure 1:
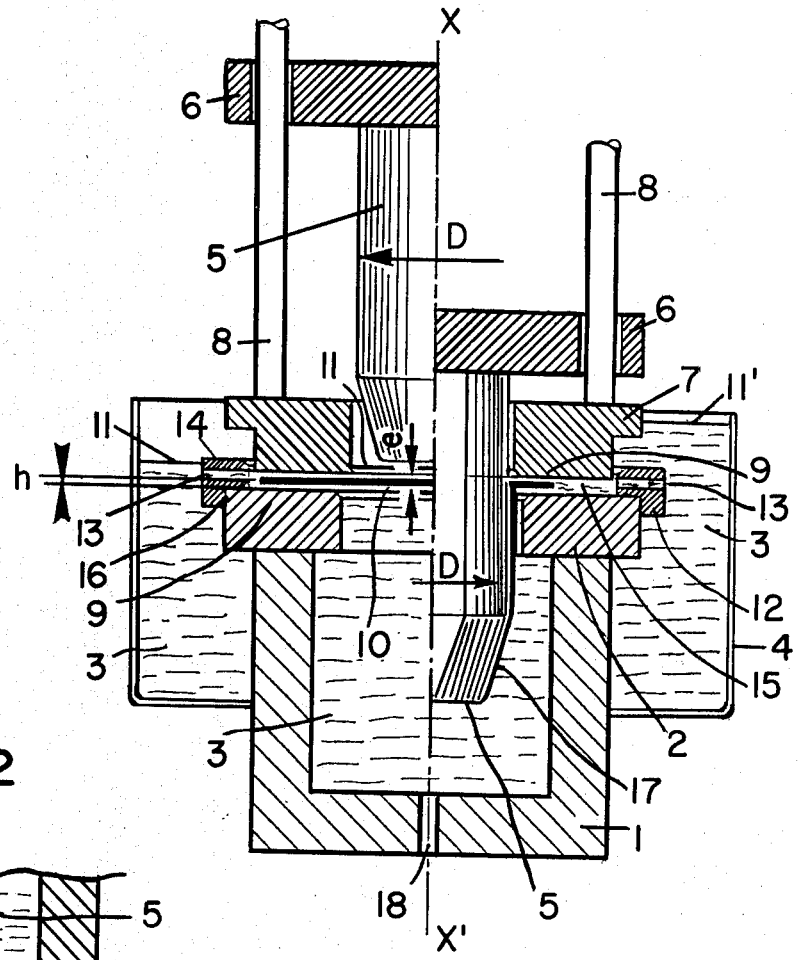
FIG. 1 is a sectional view taken through an apparatus such as is used to perform hydro-mechanical stamping, the apparatus comprising a centering ring according to the invention and wherein the Figure is vertically separated along axes XX' to allow the left portion of the Figure to indicate the relative positions of the elements comprising the machinery at the initiation of stamping and to allow the right half of the Figure to illustrate the positions of the various machine elements at the end of stamping; and, FIG. 2 is a detailed sectional view of a portion of the hydro-mechanical apparatus of FIG. 1 and particularly illustrating a discharge structure according to the invention.

The female tool can be seen in cross-section in FIG. 1. It comprises a pressure chamber 1, bounded at the top by a stamping ring 2, all submerged in a liquid 3 which is held in a tank of large diameter 4. The liquid used is a mixture of water and soluble oil. A stamping punch 5 is shown, rigidly connected to the upper plate 6 of the press, which drives it from the inoperative position on the left to the end-of-stamping position shown in the right half-section. A blank holder 7 is actuated by uprights 8 as in conventional machinery, and holds the flange 9 of the blank 10 tightly against the stamping ring 2.

In the left half-section it will be noted that the level 11 of the liquid prior to stamping is above the upper plane of the stamping ring 2 and even above the blank 10, which is completely submerged. The blank is centered by a centering ring 12 according to the invention. The lateral clearance between the blank 10 and the centering ring 12 is only a few tenths of a millimeter. The ring 12 contains 8 radial holes 13, which allow the liquid levels inside and outside the ring to be constantly equalised. This is despite the fact that in the inoperative position the upper surface 14 of the centering ring 12 rises above the liquid 3, as shown in the left-half of the figure. For the blank holder 7 to operate, it must obviously have a thicker portion 15 at the center, fitting into the centering ring 12 with a clearance of a few tenths.

To give it a good centering action, the ring 12 is itself fixed onto the drawing ring with nesting 16.

It will be noted that the distance h between the lower generatrices of the holes 13 and the upper surface of the ring 2 is greater than the thickness e of the blank 10.

Thus, at the commencement of the stamping operation the liquid compressed in the pressure chamber 1 cannot escape directly towards the tank 4 but must follow a circuitous path comprising an initial vertical portion between the blank 10 and the centering ring 12 then between the blank holder 7 and the ring 12 before exiting towards the tank 4 by way of the holes 13. This gives rise to a certain loss of pressure which makes the flow rate around the blank 10 uniform and prevents a localised rupture in the film of oil between the blank and the stamping ring 2 at the location of the holes 13 which establish communication between the liquid in the chamber 1 and the tank 4. This rupture in the film would cause a metal-on-metal contact between the blank 10 and the stamping ring 2. As a result, it would bring about the rupture of the blank in the region where the deformation giving rise to the skirt of the article 17 has its beginning.

It will be noted that the clearance between the blank holder 7 and the ring 12 is itself very small, being in the order of 1/10 mm along the radius.

In the example shown in the right-half section, the stamped article 17 is a solid of revolution about the axis XX'. However, the method is also capable of producing objects where the section through horizontal planes is not circular but, for example, rectangular with rounded edges.

The pressure chamber 1 finally contains an emptying aperture 18, which may equally be used for pump controlled filling.

The method can easily be understood by referring to FIG. 1. With the punch 5 and blank holder 7 both raised, the tank 4 and pressure chamber 1 are filled with liquid 3 to the level 11, very slightly below the upper level 14 of the centering ring 12. The levels 11 inside and outside the ring 12 are balanced very easily through the radial communication holes 13. The blank 10 can then easily be positioned in the centering ring which rises above the liquid. The blank holder 7 is lowered and presses firmly onto the flange 9 of the blank. The level 11 has risen very slightly, but the upper surface 14 of the centering ring 12 remains visible. The punch 5 descends and gives the blank 10 the shape of the desired article 17. Pressure in the chamber 1 rises rapidly. The liquid 3 presses the blank 10 against the punch 5 and escapes below the flange 9, pressing it against the blank holder 7. It raises the level in the tank 4 to 11'. The article 17 can then be ejected by any device, e.g. a device with a spring fixed to the bottom of the chamber 1.

Stamping can be carried out very rapidly, without any danger of bad centering, inadequate filling of the chamber or inadequate greasing, of the blank.

It is advisable to make the radial holes 13 as numerous and as wide as possible. There may be depressions which are upon at the upper part of the centering ring 12. All that is required to facilitate the positioning of the blank is for the upper surface 14 of the centering ring 12 to be visible.

With the arrangement described cylindrical cases of dimensions D=65 mm, H=78 mm have easily been produced from blanks with a diameter F of 160 mm and a thickness of 0.27 mm. We have also manufactured cases with frustoconical lateral walls, like the article 17 shown here, and even cases with conical lateral walls and a spherical or ogival base.

Figure 2:
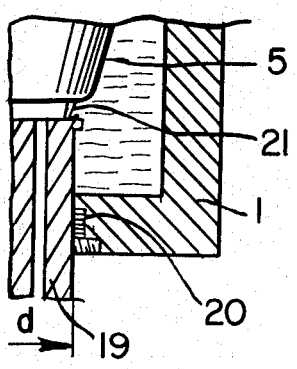

In order to reduce the work of the punch 5, it is possible to use a discharge means in the form of a cylindrical ring 19 similar to that shown in partial section in FIG. 2. From the beginning of the stamping process the ejector 19 is pressed against the blank 10 opposite the punch 5, and accompanies the bottom of the case 17 during its descent within the chamber 1. The seals 20 and 21 ensure that there is no liquid or pressure between the blank 10 and the ejector 19 over a circle of diameter d within the seal 21. All that the punch 5 has to overcome is the pressure exerted on a rim of internal diameter d and external diameter D.

When the punch has reached the end of its stroke the ejector 19 is raised and ejects the article 17.

A means for limiting or controlling the liquid pressure can finally be provided, connected to an aperture such as the aperture 18, which passes through the wall of the chamber 1.

This method eliminates the greasing of the blank prior to stamping and the de-greasing of the article after stamping.

What is claimed is:

1. In a hydro-mechanical stamping method wherein a liquid-filled pressure chamber is bounded at the top by a stamping ring having an aperture with a section corresponding to the largest section of a punch mounted above the chamber for descent into the chamber to pressurize the liquid therein and to deform a blank, the improvement comprising the steps of:

(a) maintaining the level of the liquid within the chamber constantly above the stamping ring and above the upper plane of the blank, the blank thereby being submerged within the liquid even prior to initiation of stamping, and (b) centering the blank relative to the stamping ring within the liquid and providing circuitous paths between the blank, the stamping ring and structure used to center the blank in order to prevent localized rupture of the blank.

2. In a hydro-mechanical apparatus for stamping a blank wherein a liquid-filled pressure chamber is bounded at the top by a stamping ring containing an aperture having a section corresponding to the largest section of a punch mounted above the chamber for descent into the chamber to pressurize the liquid therein and to deform the blank; the improvement comprising, a centering ring surmounting and mounted to said stamping ring, the centering ring being annular to hold the blank therewithin, and being provided with radially extending apertures which allow flow of liquid from the pressure chamber between the stamping ring and the blank and through the centering ring.

3. In the apparatus of claim 2 and further comprising means for maintaining the liquid level within the pressure chamber above the upper plane of the blank.

4. In the apparatus of claim 2 wherein a distance h between lower generatrices of the apertures and the surface of the stamping ring is greater than the thickness e of the blank to be stamped.

5. In the apparatus of claim 2 wherein the improvement further comprises:

ejector means for preventing liquid from being pressured below the central part of the blank, the ejector means being pressed against the blank from opposite the punch; and, means for sealing the ejector means within a lower portion of the pressure chamber.

* * * * *